US010315834B2

(12) United States Patent
Carrette et al.

(10) Patent No.: US 10,315,834 B2
(45) Date of Patent: Jun. 11, 2019

(54) MULTI-CAN MARKER STICK

(71) Applicant: FlagShooter Holdings, LLC, Garretson, SD (US)

(72) Inventors: Paul M Carrette, Garretson, SD (US); Robert W Bishop, Baltic, SD (US)

(73) Assignee: FlagShooter Holdings, LLC, Garretson, SD (US)

( * ) Notice: Subject to any disclaimer, the term of this patent is extended or adjusted under 35 U.S.C. 154(b) by 0 days.

(21) Appl. No.: 15/452,872

(22) Filed: Mar. 8, 2017

(65) Prior Publication Data

US 2017/0259988 A1 Sep. 14, 2017

Related U.S. Application Data

(60) Provisional application No. 62/305,436, filed on Mar. 8, 2016.

(51) Int. Cl.

| | |
|---|---|
| ***B65D 83/20*** | (2006.01) |
| ***B05B 12/14*** | (2006.01) |
| ***G09F 17/00*** | (2006.01) |
| ***B65D 83/68*** | (2006.01) |
| ***E01C 23/22*** | (2006.01) |
| ***A63C 19/06*** | (2006.01) |

(52) U.S. Cl.

CPC ..... *B65D 83/203* (2013.01); *A63C 19/06* (2013.01); *B65D 83/68* (2013.01); *E01C 23/227* (2013.01); *G09F 17/00* (2013.01); *B05B 12/1409* (2013.01)

(58) Field of Classification Search

CPC .. B65D 83/203; B65D 83/68; B05B 12/1409; G09F 17/00; E01C 23/227; A63C 19/06

See application file for complete search history.

(56) References Cited

U.S. PATENT DOCUMENTS 3,084,871 A * 4/1963 Puglis ..... B65D 83/386 221/127
3,485,206 A * 12/1969 Smrt ..... E01C 23/227 118/305
3,559,890 A * 2/1971 Brooks ..... B05B 7/1209 239/304
3,700,144 A * 10/1972 Smrt ..... A63C 19/08 222/609
3,796,353 A * 3/1974 Smrt ..... A61C 19/08 222/612
4,262,821 A * 4/1981 Smrt ..... B65D 83/203 118/305
4,496,081 A * 1/1985 Farrey ..... B05B 1/30 137/607

(Continued)

*Primary Examiner* — Frederick C Nicolas

(74) *Attorney, Agent, or Firm* — Etherton Law Group, LLC

(57) ABSTRACT

A device that can hold at least two cans of spray paint or chalk, thus enabling marking with different colors using a single device. The device comprises a staff, a can holster, a grip, a trigger and a selector. The selector comprises a selector rod moveable in or alongside the staff. At one end of the selector rod is a selector knob and at the other is an engagement mechanism that engages the spray valve of each can, one can at a time. The engagement mechanism comprises a cam and a rocker arm with two opposing fingers, one to engage each spray can when selected. Optionally one or more flag holders may be attached to the staff for holding marker flags.

16 Claims, 8 Drawing Sheets

(56) References Cited

U.S. PATENT DOCUMENTS

| | | | | | |
|---|---|---|---|---|---|
| 5,634,571 | A * | 6/1997 | Cataneo | B05B 7/32 | 222/134 |
| 5,749,522 | A * | 5/1998 | Smrt | B65D 83/203 | 239/150 |
| 5,992,707 | A * | 11/1999 | Gaichuk | B65D 83/201 | 222/321.8 |
| 6,062,443 | A * | 5/2000 | Smrt | B05B 9/007 | 222/608 |
| 6,390,336 | B1 * | 5/2002 | Orozco | B65D 83/203 | 222/162 |
| 6,698,774 | B2 * | 3/2004 | Duncan | E01C 23/163 | 222/608 |
| 7,178,280 | B1 * | 2/2007 | Passmore | G09F 21/04 | 116/173 |
| 8,192,108 | B1 * | 6/2012 | Causey | E01C 23/163 | 239/156 |
| 8,656,857 | B2 | 2/2014 | Carrette | | |
| 9,731,308 | B1 * | 8/2017 | Conrad, Jr. | B05B 11/0059 | |
| 2007/0131714 | A1 * | 6/2007 | Jutras | B05B 9/007 | 222/135 |
| 2016/0078787 | A1 * | 3/2016 | Canchola | G09F 3/005 | 40/633 |

* cited by examiner

MULTI-CAN MARKER STICK

CROSS-REFERENCE TO RELATED APPLICATIONS

This application claims the benefit of co-pending U.S. Provisional Application No. 62/305436 filed Mar. 8, 2016.

FIELD OF INVENTION

This invention relates generally to ground marking systems. This invention relates more particularly to a device that can hold at least two cans of marker paint, thus enabling marking with different colors using a single device.

BACKGROUND

It can be desirable to mark the ground surface to indicate, for example, the presence of underground utilities, the location of lot boundaries and the like. Sometimes markers are inserted into the ground that extend upward from the ground surface and may include a flag at the top end. Sometimes the ground is marked with spray paint or spray chalk, the sprayed lines indicating the approximate location of the boundary, underground pipes, wires, or cables. Different colors may be used for each utility service, such as electric, gas, telephone, water, or sewer or different boundary lines or logos. Spray paint and chalk are also commonly used to mark athletic fields with boundaries and team logos.

Conventionally, when marking with spray paint or chalk, the spray can is attached to a long rod that has a trigger grip on its upper end and a holster on its lower end to hold the can upside down. The devices are known as paint sticks or marker sticks. A metal finger extends from the bottom of the holster and engages the valve on the spray can. When the trigger is pulled the valve is depressed and paint sprays out the tip of the nozzle or dip tube. The desired locations are marked by walking to the desired location, aiming, and pulling the trigger. Larger areas are painted by walking the desired distance while spraying paint. If a different color paint is needed, either the can is replaced with the new desired color or a different marker stick is used. In either case, the user has to stop marking while changing paint colors. It would be desirable to make painting with different colors less cumbersome.

SUMMARY OF THE INVENTION

The present invention is a device that can hold at least two cans of spray paint or chalk, thus enabling marking with different colors using a single device. The device comprises a staff, a can holster, a grip, a trigger and a selector. The selector comprises a selector rod moveable in or alongside the staff. At one end of the selector rod is a selector knob and at the other is an engagement mechanism that engages the spray valve of each can, one can at a time. The engagement mechanism comprises a cam and a rocker arm with two opposing fingers, one to engage each spray can when selected. Optionally one or more flag holders may be attached to the staff for holding marker flags.

DETAILED DESCRIPTION OF THE INVENTION

Figure 1:
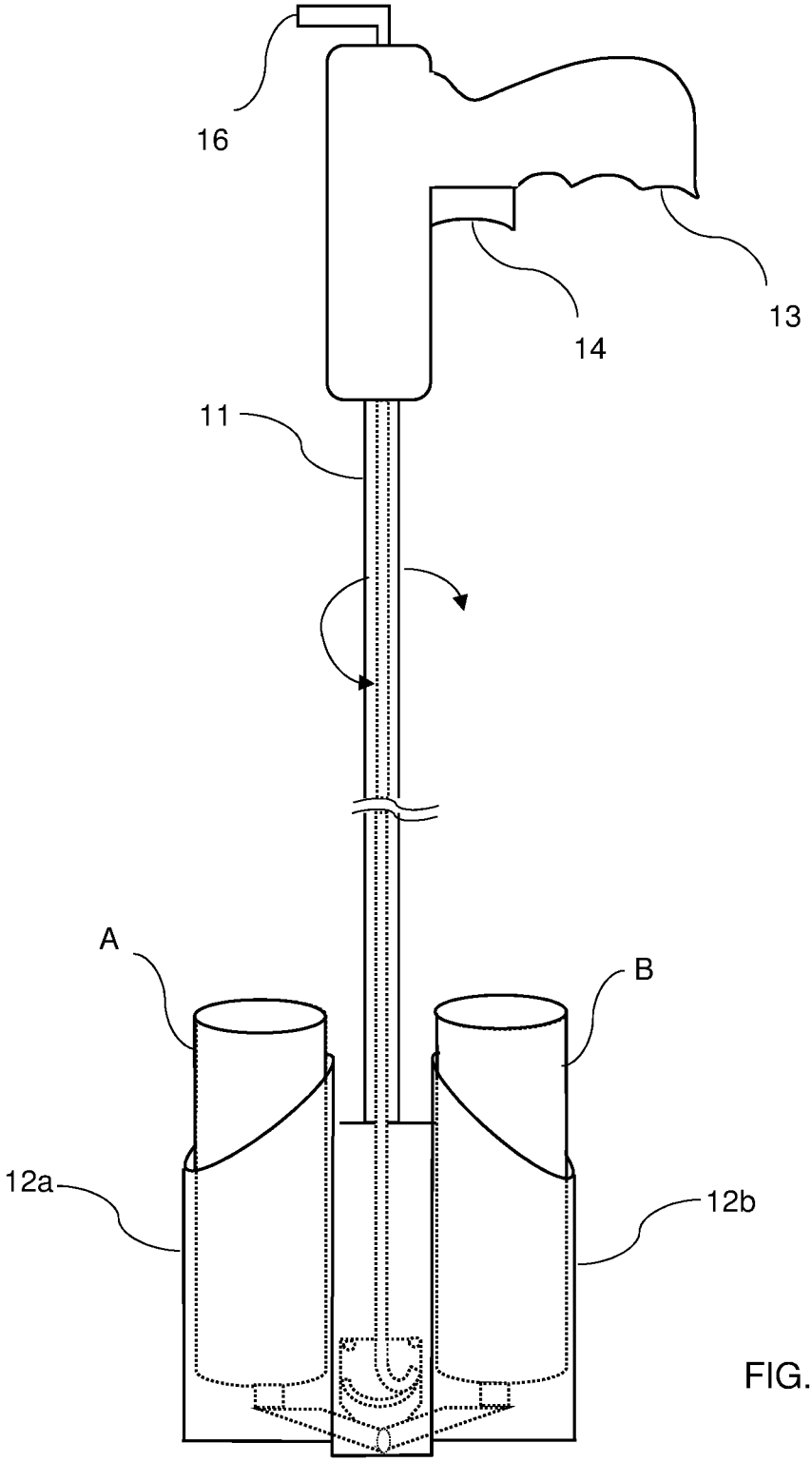
FIG. 1 is a side view of a marker stick of the present invention.

FIG. 1 is a side view of a marker stick of the present invention showing a staff 11, two can holsters 12*a* and 12*b*, a grip 13, a trigger 14, a selector rod 15, and a selector knob 16. Two cans of spray paint or chalk (referred to hereinafter as just paint), first can A and second can B, can be retained within the holsters 12*a* and 12*b*, respectively. The cans are retained in the holsters with the valve pointing down so that paint is sprayed from the bottom of the device. A can holster may be of any configuration that holds the can substantially parallel to the staff 11, such as c-shaped resilient bands or solid-wall cylinders, such as those as shown in FIGS. 1, 4, 6, and 8.

Figure 2:
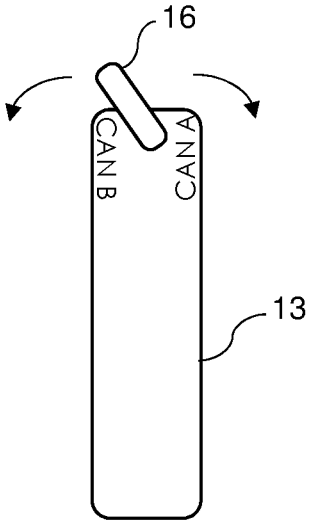
FIG. 2 is a rear view of FIG. 1 showing the selector knob selecting can B.
Figure 3:
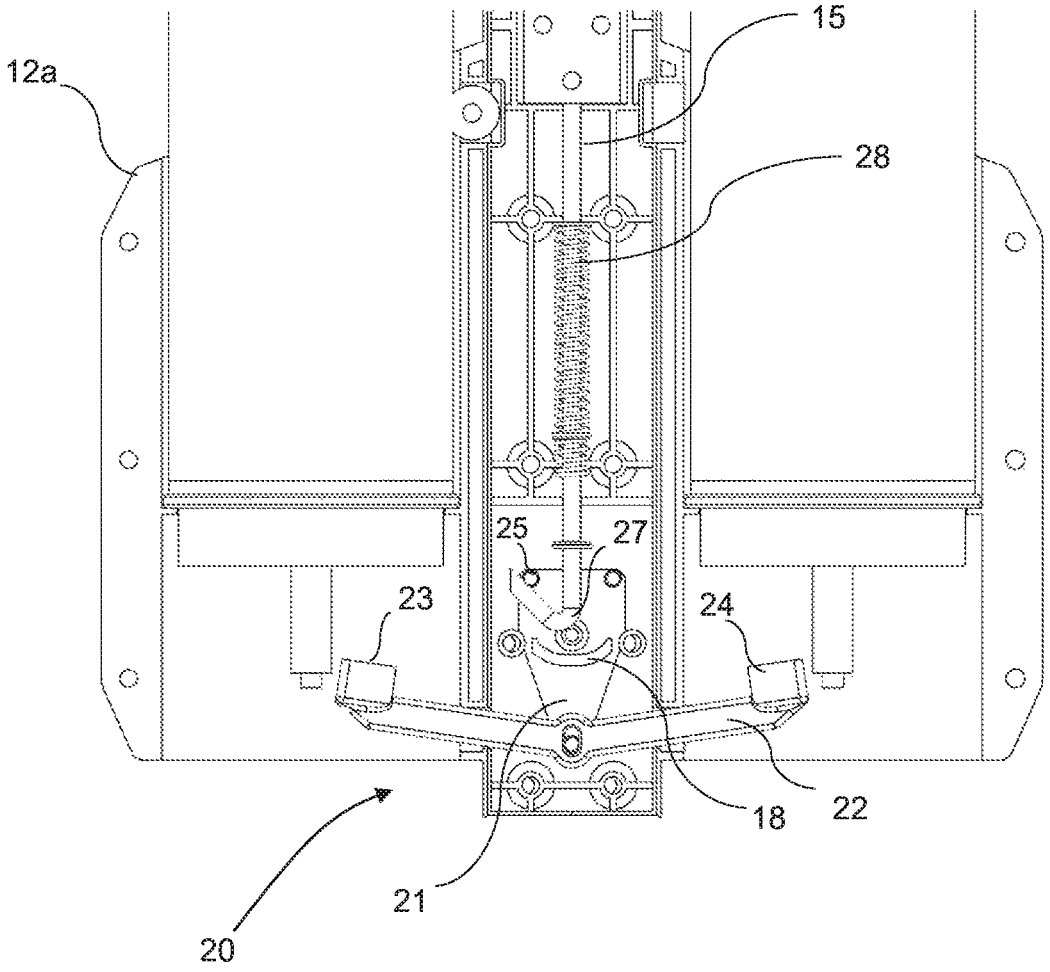
FIG. 3 is a partial, cut-away view of the marker stick showing the engagement mechanism set to cause paint to spray from can A.
Figure 4:
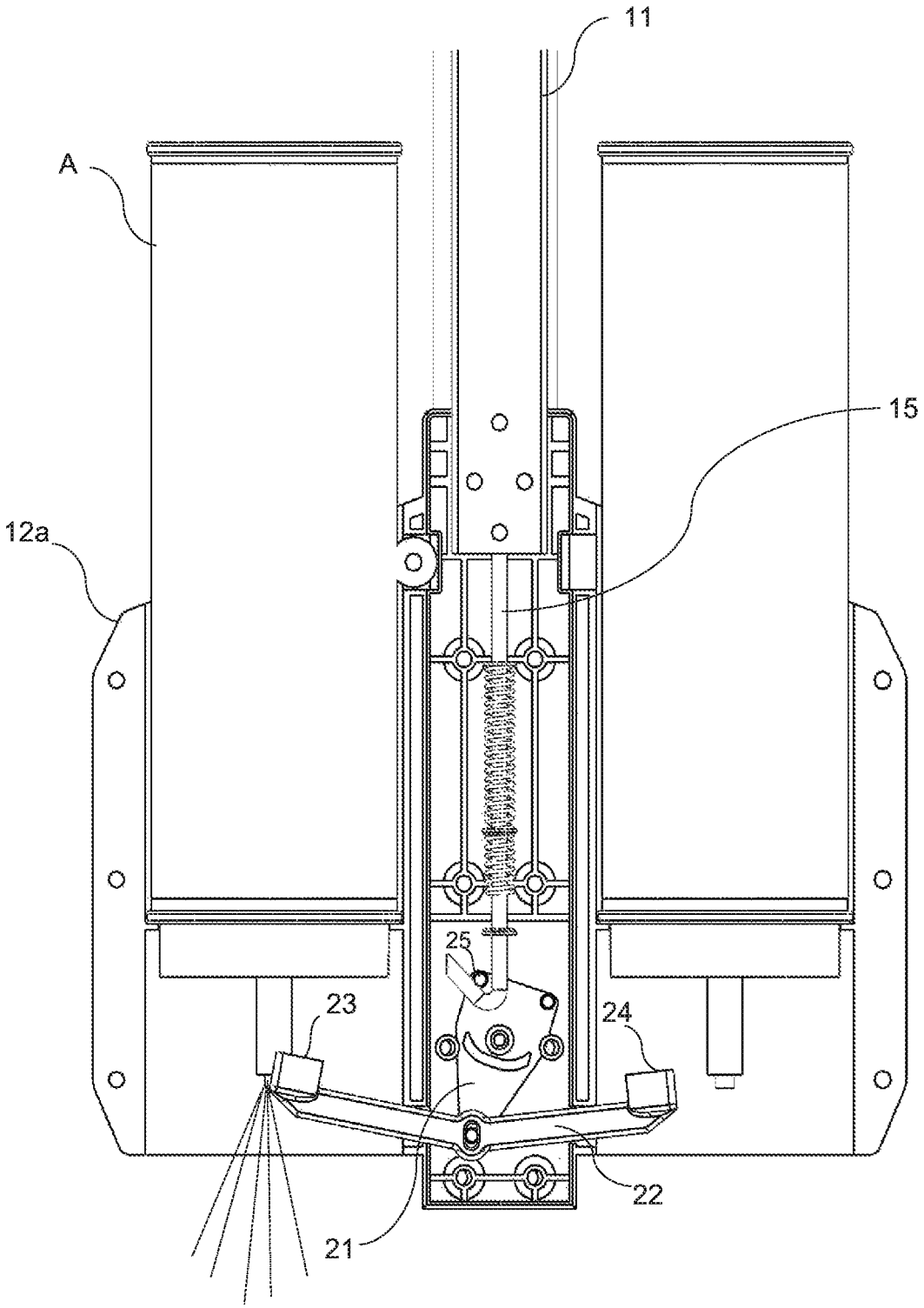
FIG. 4 is a partial, cut-away view of the marker stick showing the engagement mechanism engaging can A.
Figure 5:
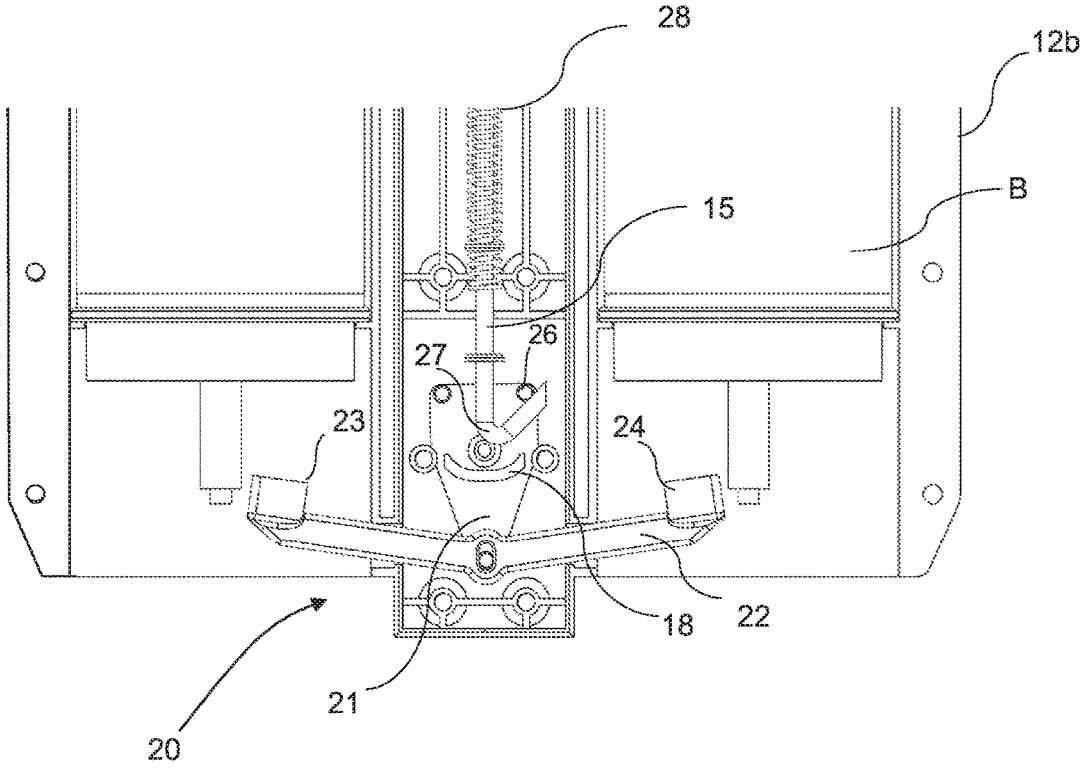
FIG. 5 is a partial, cut-away view of the marker stick showing the engagement mechanism set to cause paint to spray from can B.
Figure 6:
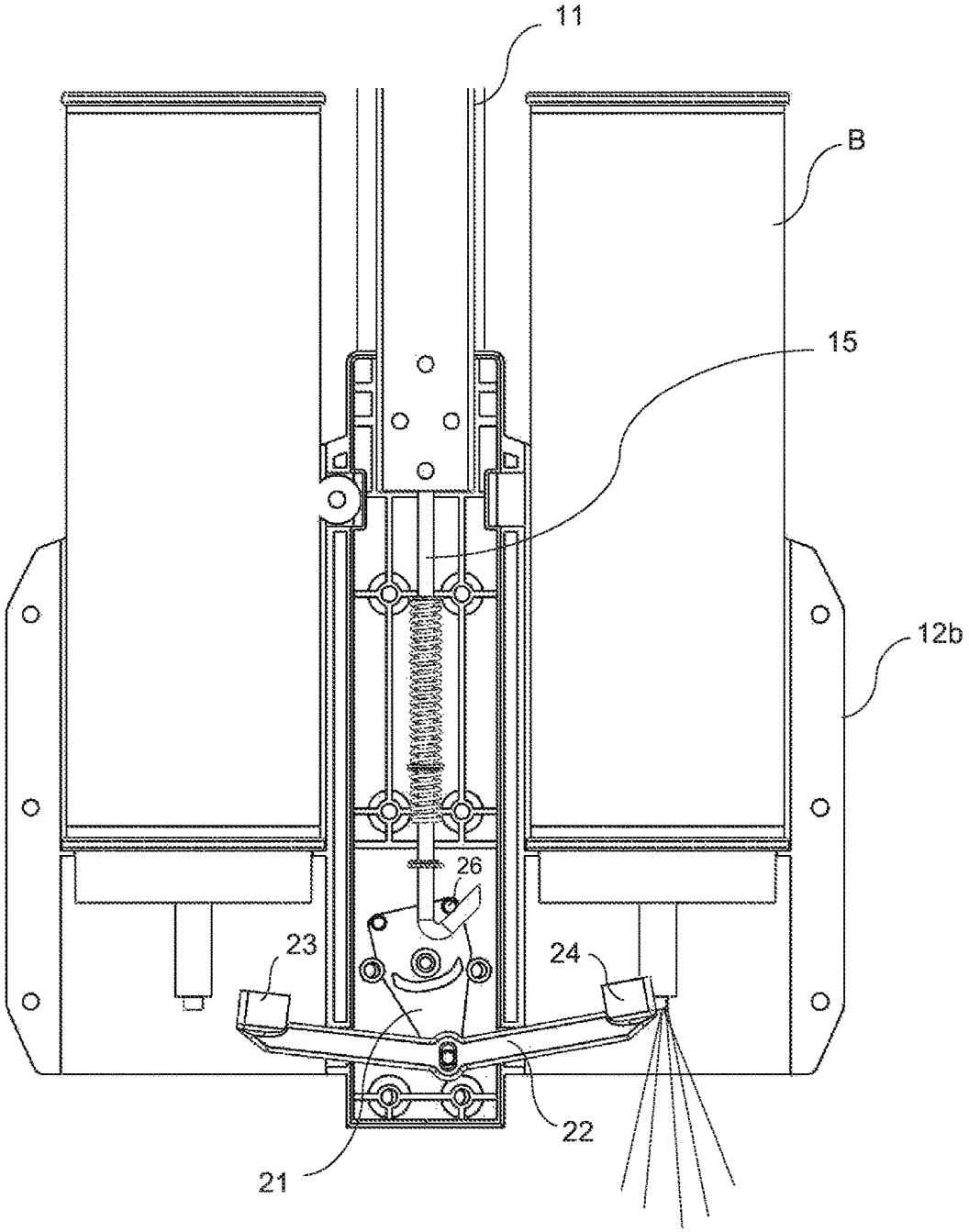
FIG. 6 is a partial, cut-away view of the marker stick showing the engagement mechanism engaging can B.
Figure 7:
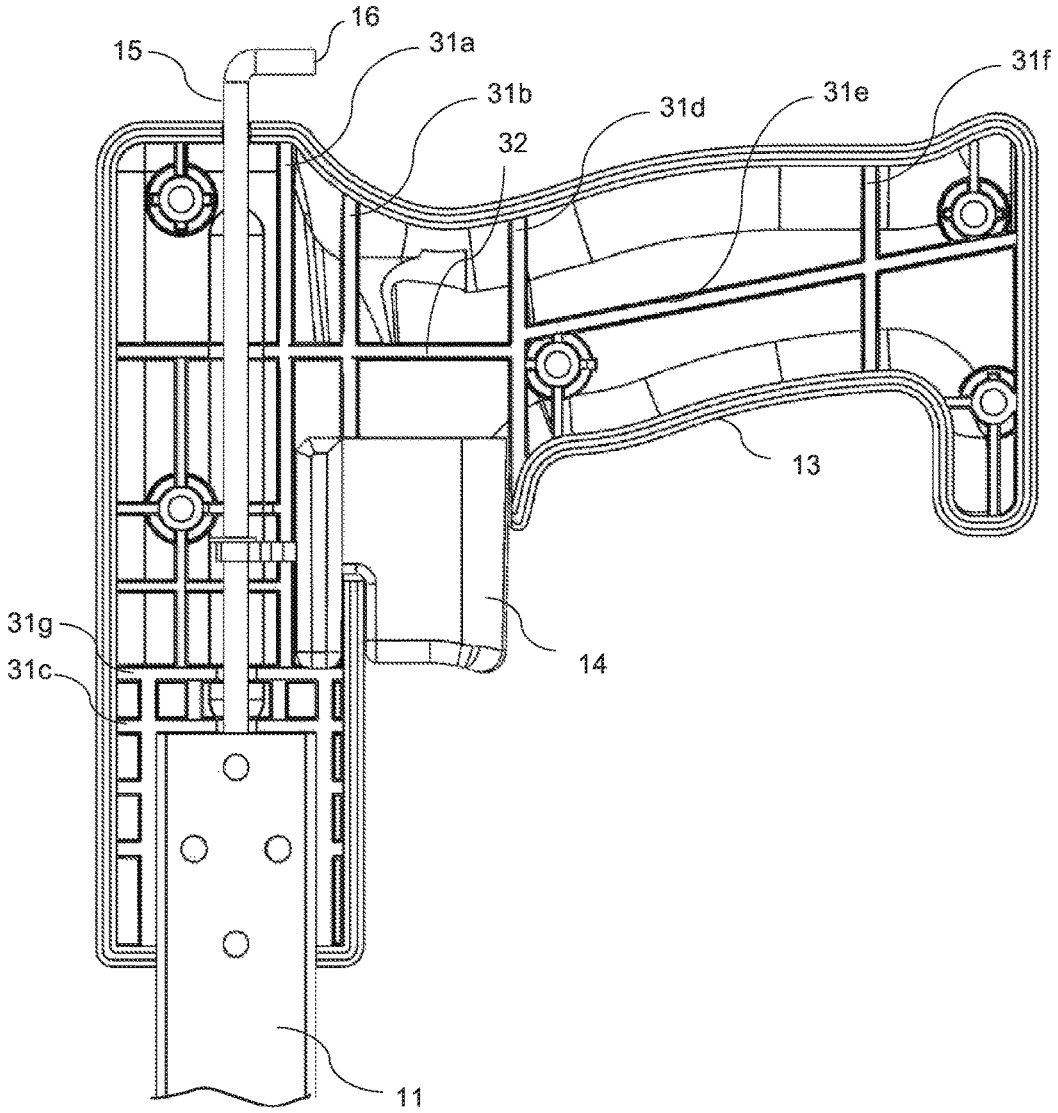
FIG. 7 is a cut-away view of the grip.
Figure 8:
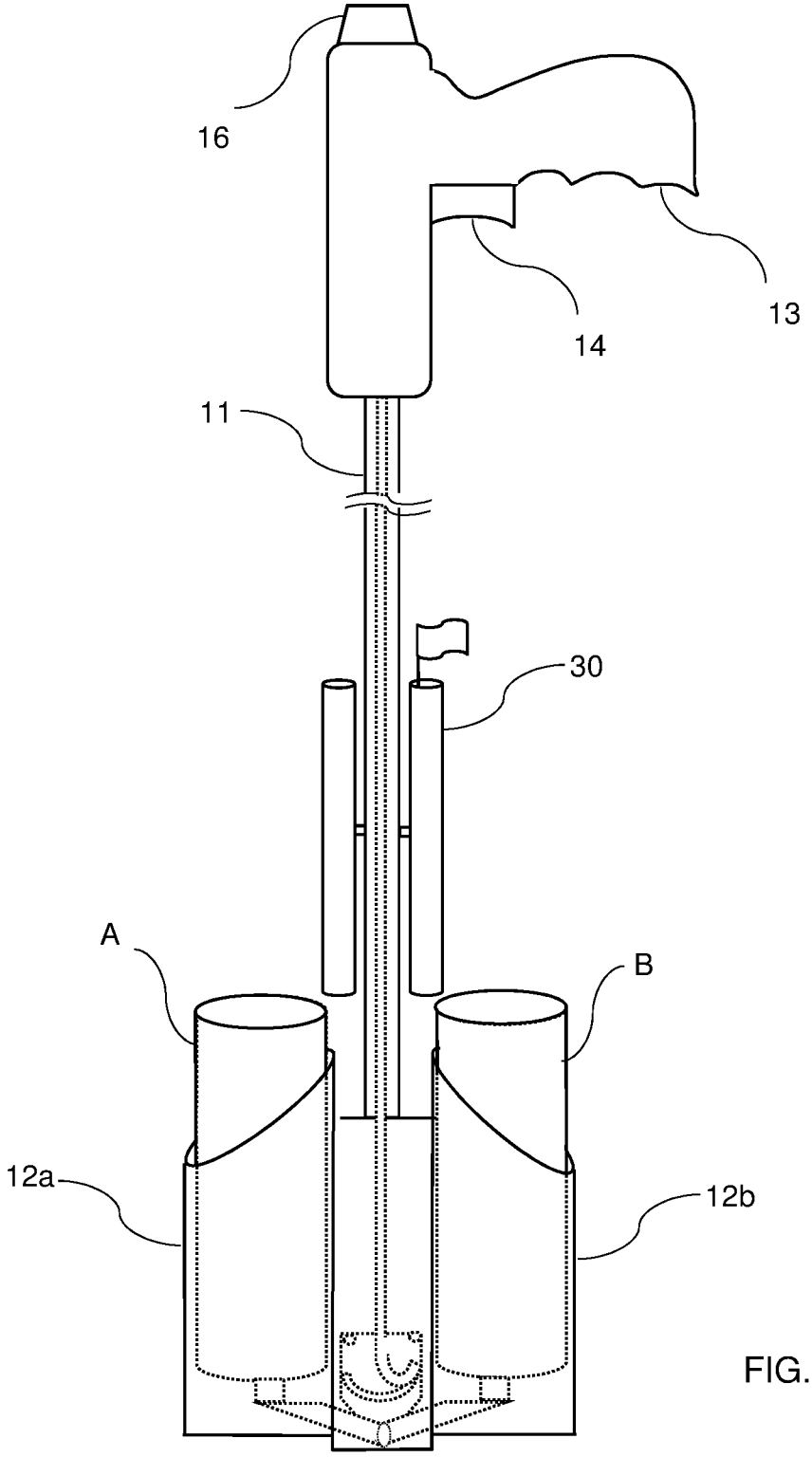
FIG. 8 is a side view of a marker stick of the present invention with optional flag holders.

The selector rod 15 runs alongside or, preferably, inside the staff, as shown in FIGS. 1-7. One end of the selector rod 15 is connected to a device that sets the selector rod to spray paint from a desired can, referred to herein as a selector knob 16. The selector knob may be a projection that turns a switch, a slider, a button or other means of choosing which can of paint is desired. The knob may have a cap-like shape, be an extension of the selector rod itself, or other shape. The other end of the selector rod 15 has a hook 27 that cooperates with an engagement mechanism 20, as explained in more detail below. The selector rod 15 is rotatable in or alongside the staff, as shown by the curved dashed arrow in FIGS. 1 and 2. The selector knob 16 or end of the staff 11 may have indicia to show which can is being selected, as shown in FIG. 2. The selector knob 16 is rotated from a first position to a second position, which in turn rotates the hook 27 from a first position to a second position, to select which can of paint will be engaged. See FIG. 2. The selector rod rests in a U-shaped guide 18. The U-shaped guide serves to urge the hook 27 to the center of the guide, thereby encouraging it to be in a neutral position when the trigger is released. This in turn prevents the device from inadvertently continuing to spray paint after the trigger is released, which might happen on occasion if the engagement mechanism 20 or selector rod 15 becomes sticky with dirt or paint and fails to move freely. Optionally the selector rod may be spring biased or use detents to hold it in the selected position.

The trigger 14 is connected to the selector rod 15 such that when the trigger is pulled the selector rod moves, preferably in an amount proportional to the depth of the trigger pull. The trigger has a draw stop 32, which prevents the trigger 14 from being pulled farther than a desired amount, which prevents against inadvertent damage from aggressive use. A trigger spring 28 biases the trigger 14 to default to the off position when not depressed by a user's finger. See FIGS. 3 and 5.

The selector rod 15 cooperates with an engagement mechanism 20 such that, when the trigger 14 is pulled, paint sprays from the selected pressurized can. The engagement mechanism 20 comprises a cam 21 and a rocker arm 22. The cam 21 has two pins extending therefrom, pin 25 relating to can A and pin 26 relating to can B. Rocker arm 22 has two opposing fingers 23 and 24; finger 23 to engage can A and finger 24 to engage can B, when selected. The hook 27 of selector rod 15 cooperates with pin 25 or 26 to cause a finger 23 or 24, respectively, to engage the spray valve (not shown) on the selected can so that paint sprays out.

For example, to spray paint from can A, the selector knob 16 is rotated to engage can A. See FIG. 3. Then the trigger 14 is pulled, causing the selector rod 15 to be drawn towards the grip 13 and to engage pin 25. See FIG. 4. As a result, the rocker arm 22 is drawn up towards the grip 13, causing finger 23 to depress the spray valve (not shown) on can A, thus releasing the pressurized paint from can A.

Similarly, to spray paint from can B, the selector knob 16 is rotated to engage can B. See FIG. 5. Then the trigger 14 is pulled, causing the selector rod to be drawn towards the grip 13 and to engage pin 26. See FIG. 6. As a result, the rocker arm 22 is drawn up towards the grip 13, causing finger 24 to depress the spray valve (not shown) on can B, thus releasing the pressurized paint from can B. In this manner two different colors of paint, one each from can A and B, can be sprayed using a single device, without the need to change cans of paint.

Numerous features serve to ruggedize the device to better support the additional weight of multiple cans and for better resistance to wear, stress, and abuse. Preferably the grip 13 is made of mated halves that fit together to form a pistol-shaped handle. The grip is made of sturdy material such as thermoplastic plastic or aluminum of at least about 0.1 inch and preferably between 0.1 and 0.2 inches thick. The halves are attached together with screws or, in some cases, by snap fit, or both. The halves may be substantially solid, or may be hollow with multiple internal ribs 31*a-g* to strengthen the grip 13. The draw stop 32 is a rib that prevents the trigger from being drawn back so far that it damages other internal parts. Preferably the selector rod 15 is at least partially encased in the grip 13, as well as being inside a hollow staff. The engagement mechanism is preferably also housed in the staff to help keep it clean and protected from mechanical harm. The trigger 14 is also preferably encased by the grip 13 except for the portion that the finger touches to pull it, as opposed to a crescent shape that has both curved sides exposed. The trigger 14 is preferably a sliding trigger, as opposed to a pivoting trigger.

Optionally one or more flag holders 30 may be attached to the staff 11 for holding marker flags. See FIG. 8. Optionally a wheel may be attached at the bottom of the device for rolling the marker stick along the ground. Preferably the wheel is centered between the can holsters 12*a* and 12*b* on a horizontal axis so that the wheel rim extends below the can holster. Alternatively a wheel may be in front or to the side of one can holster, or multiple wheels can be attached, each in front or the side of a can holster.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

The invention claimed is:

1. A marker stick comprising:

a. a staff;

b. two or more can holsters connected to the staff, each configured to hold a spray can;

c. a selector rod configured to select among the can holsters;

d. an engagement mechanism configured to engage a spray valve of the spray can in the selected can holster;

e. a trigger configured to operate the engagement mechanism;

f. a cam with a first pin and a second pin; and g. a rocker arm with a first finger and a second finger;

wherein the selector rod cooperates with the first pin to cause the first finger to engage the spray valve of the can in the selected can holster.

2. The marker stick of claim 1 further comprising a trigger draw stop.

3. The marker stick of claim 1 further comprising a flag holder.

4. A marker stick comprising:

a. a hollow staff;

b. two or more cylindrical can holsters connected to the staff, each configured to hold a spray can;

c. a selector rod inside the staff, the selector rod configured to select among the can holsters;

d. an engagement mechanism inside the staff, the engagement mechanism configured to cooperate with the selector rod and engage a spray valve of the spray can in the selected can holster;

e. a selector knob, wherein the selector knob and a trigger are connected to a grip which is connected to the staff; and f. the trigger is configured to operate the engagement mechanism, wherein the selector rod is disposed in the grip.

5. The marker stick of claim 4 wherein the grip further comprises a plurality of ribs.

6. The marker stick of claim 4 wherein the engagement mechanism is disposed in the staff and comprises:

a. a cam with a first pin and a second pin; and b. a rocker arm with a first finger and a second finger;

wherein the selector rod cooperates with the first pin to cause the first finger to engage the spray valve of the can in the selected can holster.

7. The marker stick of claim 4 further comprising a flag holder.

8. The marker stick of claim 4 further comprising a trigger draw stop.

9. A marker stick comprising:

a. a staff having a grip end and a bottom end;

b. a first can holster connected to the staff at or near the bottom end of the staff, the can holster configured to hold a first can;

c. a second can holster connected to the staff at or near the bottom end of the staff, the second can holster configured to hold a second can;

d. a selector rod moveable in or alongside the staff, the selector rod having a grip end and a bottom end;

e. a selector knob at the grip end of the selector rod configured to select between the can holsters;

f. an engagement mechanism at the bottom end of the selector rod configured to engage a spray valve of a can in a selected can holster;

g. a grip attached to the staff at the grip end and configured to receive the selector rod such that the selector knob extends outside the grip; and h. a trigger configured to operate the engagement mechanism, the trigger operable when holding the grip.

10. The marker stick of claim 9 wherein the engagement mechanism comprises:

a. a cam with a first pin and a second pin;

b. a rocker arm with a first finger and a second finger;

c. wherein the selector rod cooperates with the first pin to cause the first finger to engage the spray valve of the can in the selected can holster.

11. The marker stick of claim 9 further comprising a flag holder attached to the staff.

12. The marker stick of claim 9 wherein the selector rod is rotatable from a first position to select the first can to a second position to select the second can.

13. The marker stick of claim 9 wherein the selector rod is disposed in the grip.

14. The marker stick of claim 9 wherein the grip further comprises a plurality of ribs.

15. The marker stick of claim 9 wherein the engagement mechanism is disposed in the staff.

16. The marker stick of claim 9 further comprising a trigger draw stop.

* * * * *